US005779538A

United States Patent [19]

Jardinier

[11] Patent Number: 5,779,538

[45] Date of Patent: Jul. 14, 1998

[54] METHOD AND DEVICE FOR ADJUSTING THE VENTILATION OF PREMISES

[75] Inventor: Pierre P. C. J. J. Jardinier, Gournay sur Marne, France

[73] Assignee: Conseils Etudes et Recherches en Gestion de l'Air, Bussy Saint Georges, France

[21] Appl. No.: 569,939

[22] Filed: Dec. 8, 1995

[30] Foreign Application Priority Data

Dec. 15, 1994 [FR] France ..... 94 15107

[51] Int. Cl.[6] ..... F24F 11/04

[52] U.S. Cl. ..... 454/256

[58] Field of Search ..... 454/229, 256, 454/239

[56] References Cited

U.S. PATENT DOCUMENTS 4,815,657 3/1989 Tsukuda et al. .

5,507,433 4/1996 Jardinier .

FOREIGN PATENT DOCUMENTS

| | | | |
|---|---|---|---|
| 2651824 | 3/1991 | France . | |
| 63-87544 | 4/1988 | Japan | 454/256 |
| 64-23045 | 1/1989 | Japan | 454/229 |
| 64-79534 | 3/1989 | Japan | 454/256 |
| 1-163538 | 6/1989 | Japan | 454/229 |
| 4-270848 | 9/1992 | Japan | 454/256 |
| 2238405 | 5/1991 | United Kingdom . | |
| 2267363 | 12/1993 | United Kingdom . | |

*Primary Examiner*—Harold Joyce
*Attorney, Agent, or Firm*—Oliff & Berridge, PLC

[57] ABSTRACT

According to this method, the number of movements of the occupants of each premises is counted for a given time, a datum related to the activity of the occupants and to their number is deduced from this, and this datum is used directly to vary the air flow cross section and consequently the flow rate of the ventilation device of the relevant premises, in the same direction as the measured activity.

13 Claims, 4 Drawing Sheets

METHOD AND DEVICE FOR ADJUSTING THE VENTILATION OF PREMISES

The subject of the present invention is a method and device for adjusting the ventilation of premises. The invention relates more precisely to the ventilating of premises whose occupancy is variable: large offices, meeting rooms, restaurants, living rooms, etc.

BACKGROUND OF INVENTION

Formerly, offices were ventilated in a continuous manner; with the rise in the cost of energy, the times of ventilation have been restricted in accordance with working hours with the aid of clocks mounted on the ventilators; more recently, the presence or absence of persons in the offices has been taken into account in order to set the air flow rates individually room by room, but in on or off mode (normal ventilation or no ventilation).

There are also systems for counting the people entering a room, for the biggest rooms, so as to adjust the air flow rate as a function of the actual number of occupants of the room.

Flow rate controls are also found which rely on measuring the carbon dioxide ratio (proportional to the respiration of the occupants) , in the rooms to be ventilated; however, measurement of the $CO_2$ ratio is economically possible only in large rooms and, moreover, this type of control entails a permanently rather high $CO_2$ ratio since the crossing of a threshold in awaited before beginning ventilation, and since thin level is subsequently maintained.

Counting of people is more satisfactory since it allows ventilation to be begun as soon as the occupants enter the room; nevertheless, this technique requires fairly heavy-weight equipment, the wiring together of the various air vents and connection with the mounting barrier at the door; it too is therefore designed for fairly big rooms, enabling the cost to be shared but over a large flow rate.

The on or off control of small offices as a function of the presence or absence of occupants is entirely satisfactory, but is rather unsuitable for bigger rooms, as it is too coarse.

SUMMARY OF THE INVENTION

The purpose of the present invention is specifically to obtain control of the ventilation of rooms of average size whose occupancy, that is to say the number of occupants and their activity ratio, is variable.

BRIEF DESCRIPTION OF THE DRAWINGS

Several examples of implementation of the method and of the device for adjusting the ventilation of premises are described below, with reference to the drawings in which.

DETAILED DESCRIPTION OF PREFERRED EMBODIMENTS

Figure 1:
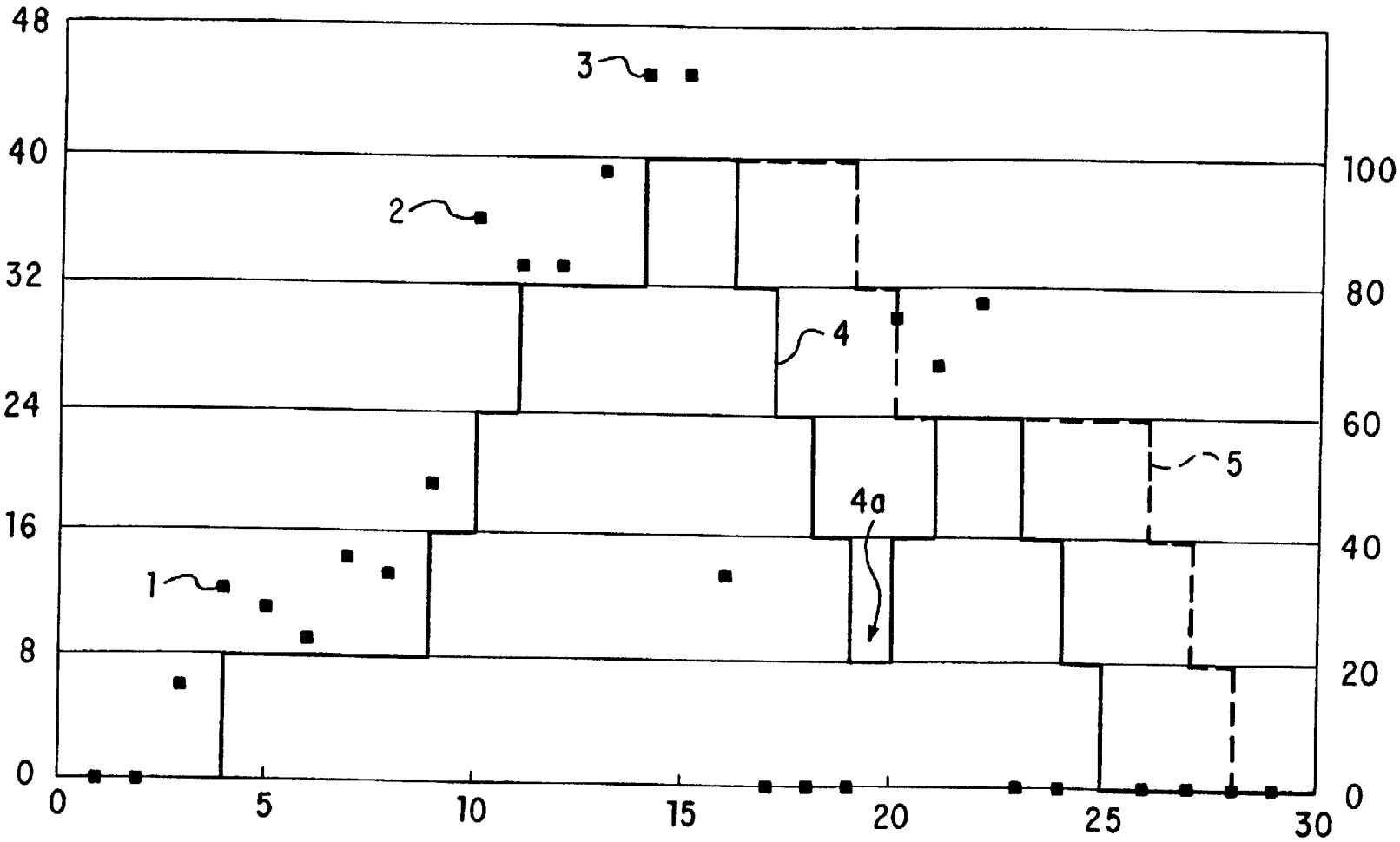
FIG. 1 is a diagram illustrating the principle of the method of the invention: the air flow rate read as ordinate on the right, as a function of the integrated number of movements as ordinate on the left, the time being plotted as abscissa.

The method of adjusting the ventilation of premises according to the invention is characterized in that the number of movements of the occupants of the premises is counted for a given time, a datum related to the activity of the occupants and to their number is deduced from this, and this datum is used directly to vary the air flow cross section and consequently the flow rate of the ventilation device, in the same direction an is the measured activity.

The count of the number of movements is obtained by a pyro-electric detector such as a passive sensor of infrared radiation, a multiple lens for splitting the premises into zones, and processing electronics of known type.

The ventilation requirement is therefore conveyed by reading the activity ratio of the occupants. The more motions are counted during the same given time, the more it may be assumed that there are people present in the room and the more a high flow rate is associated; conversely, as the number of movements decreases, the ventilation flow rate is reduced.

Although this technique is not strictly accurate at a given moment, it is valid since the ventilating of premises is designed to remove the pollutants whose concentration varies slowly. By virtue of the inertia of the phenomenon, in general (and on average) the quality of the air will be maintained above a defined threshold, even if, at a given moment, the flow rate obtained is below the flow rate which would theoretically be necessary with fixed ventilation.

For the same reason, it is unnecessary to follow the number of movements in real time. Integration over a given time is sufficient; given the inertia due to the volume of the premises and to the weak liberation of pollutants, an integration time of less than thirty minutes, preferably one to fifteen, is suitable. Indeed, if the time is too short, there are instabilities in the response of the system; the activity read is highly variable and the levels obtained unreliable. On the other hand, too long a time precludes the obtaining of a response rapidly matched to the requirement.

This integration of the number of movements is done in two ways. On the one hand, when a movement is detected, a counter is incremented thereby disabling detection for a fairly short time (a few seconds) in order to avoid one movement of large magnitude from saturating the counter and falsifying the activity measurement; it is also possible, without disabling detection, to increment the counter at regular intervals (less than thirty seconds) by a single unit, regardless of the number of detections during this period. On the other hand, the counter is read at regular intervals (less than thirty minutes) to establish the air flow rate response and the counter is reset to zero for a new measurement.

When the activity level during the fixed period has been sensed in thin way, an electrical output dependent on this level and corresponding to a ventilation flow rate is adjusted. This variable electrical output may be linear or non-linear, increasing or decreasing, continuous or stepped, with (min/max) threshold or over the whole activity range.

A linear or non-linear output makes it possible not to have the same proportionality over the whole measurement range: for example, a ventilation level may be provided which takes account of pollution due to furnishings starting right from the first occupant and subsequently to take account only of additional people with a sliding level (for example 40+30=70, +20=90, +10=100).

The choice of a continuous or stepped output depends on the accuracy with which the response of the apparatus is slaved to the demand and on the degree of reliability of the activity counter: a standard apparatus, uncalibrated, in a more or less known room does not provide very accurate results to within 10%, and it would be misguided to wish for too precise a slaving. In respect of ventilation, accuracy of the order of 10 to 20 $m^3/h$ is entirely proper.

A threshold makes it possible to disregard low activity, embraced, for example, within a minimum flow rate removing pollutants due to the building.

The electrical output may be linked directly with the level of activity measured during the integration period, or not: maximum rate of change, introduction of a lag or of hysteresis, or of a confirmation.

A maximum rate of change indicates that the raising or lowering of the variation in flow rate of the ventilation can be done only with a restricted slope: for example, if the activity level goes from 20 to 70% and the maximum slope during the rise is 15%, four successive commands (from 20 to 35, from 35 to 50, from 50 to 65 and from 65 to 70) will be necessary to take the output level from 20 to 70% (when linear).

With a lag or hysteresis, the response to the measured activity level is made some time after the measurement: for example, as the activity rises, the level at the output is followed directly: by contrast, as the activity diminishes, the response is offset by a few minutes (or by a few measurements).

In the case of a confirmation, before taking account of the observed variation in the measurement of activity, several identical measurements are awaited: this makes it possible to disregard a use-of-premises happening, for example the distributing of mail in an office.

The logic for the system can be carried out by a hard-wired device for well-defined applications which do not require complicated processing, or by a programmed device (software and microprocessor) for other applications.

For special applications, recourse may be had to the "learning" of the system: values of the response are associated, through trials, with known activity values, for example a people walking through a hall; this makes it possible to respond to a very particular requirement, outside the limits of standard hardware.

The ventilation terminal makes it possible to adjust the flow rate of air extracted or blown into a room as a function of the activity level observed; it is the inflating of a membrane or the position of a flap in an air duct at near-constant pressure which provides the flow rate; the position of the membrane or of the flap is determined by the activity level which positions for example a piston adjusting the pressure sent to the membrane or to bags which drive the flap by inflating more or less; the flap can also be operated by a motor whose time of operation is varied with respect to a fixed stop, or whose operation in associated with information feedback on the position of the flap.

According to another characteristic of the invention, a device for implementing the method comprises a device for counting the number of movements, a processing block which counts the number of movements per unit time and which computes a setpoint in the form of an output signal which acts directly on a means of controlling a member for reducing the ventilation cross section, associated with a ventilator and a network of conduits enabling the pressure in the network to remain substantially steady, i.e. within a ratio of 1 to 4.

In FIG. 1 may be seen points, such as 1, 2, 3, representing the activity measured in premises, that is to say the number of movements, plotted as ordinate on the left (from 0 to 48), per time units plotted as abscissa (from 0 to 30); the time unit is an increment of arbitrary value.

The coating of the movements is cyclic with a period of the order of a few seconds (for example ten seconds), this counting being used to increment a counter; the counter is read at fixed intervals of the order of a few minutes (for example ten minutes), the value read subsequently being compared with a prerecorded value dependent on the type of occupancy of the premises, so as to yield an output signal, whilst the counter is reset to zero.

The electrical signal adjusts the ventilation flow rate for the relevant premises. Thin flow rate is represented by the diagrams as a solid line, 4, or dashed line, 5: these diagrams give the opening ratio of a flap in an air duct, plotted as ordinate on the right (from 0 to 100%) per time units, plotted as abscissa (from 0 to 30); the diagram 4 corresponds to operation without hysteresis, whereas the diagram 5 corresponds to operation with hysteresis of 3 time units on the way down; in the second it may be seen that a lag allows the change to be smoothed by eliminating for example the well 4*a*.

Figure 2:
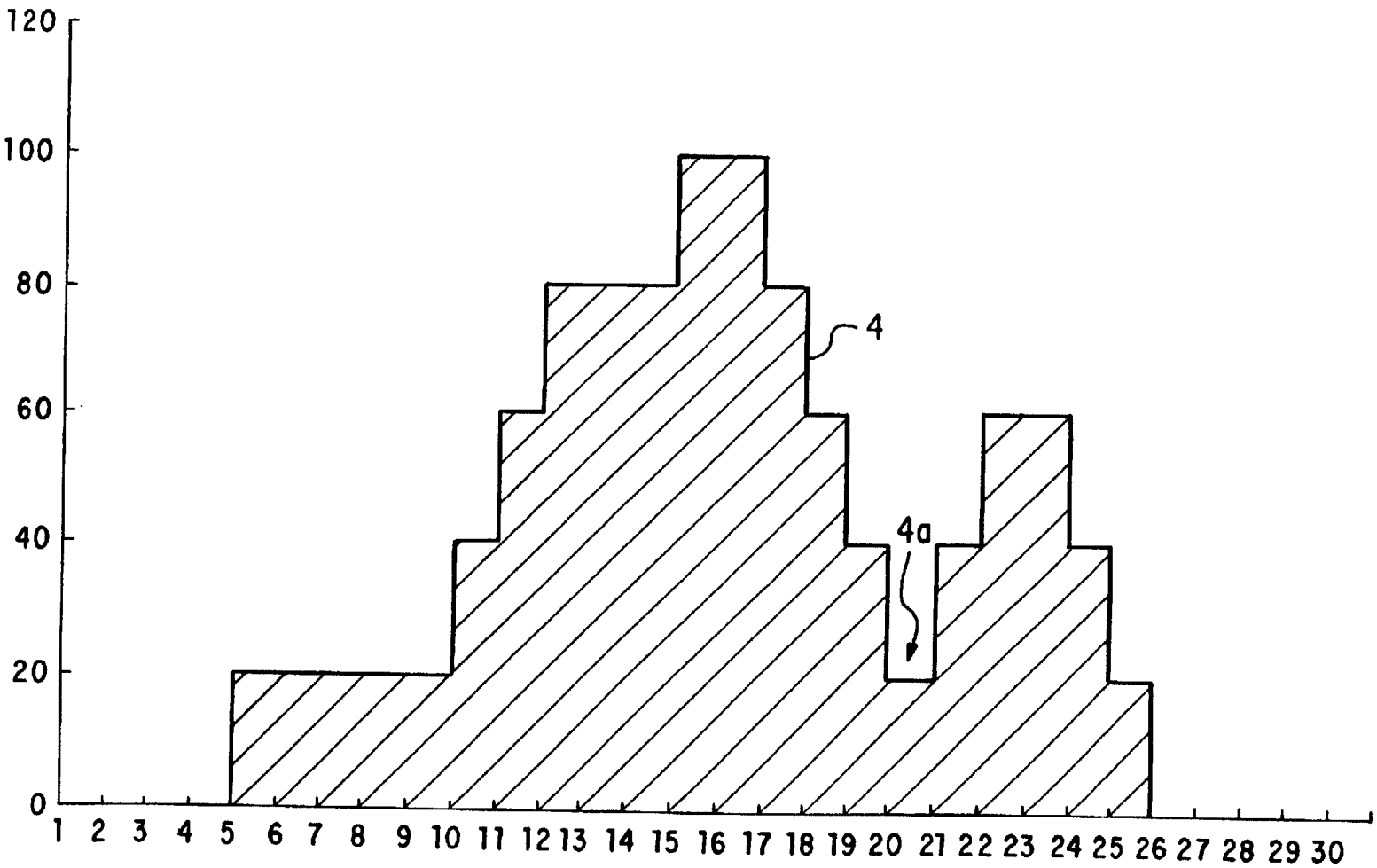
FIGS. 2 and 3 represent the areas of the two diagrams of FIG. 1, these areas being proportional to the volumes of air delivered.
Figure 3:
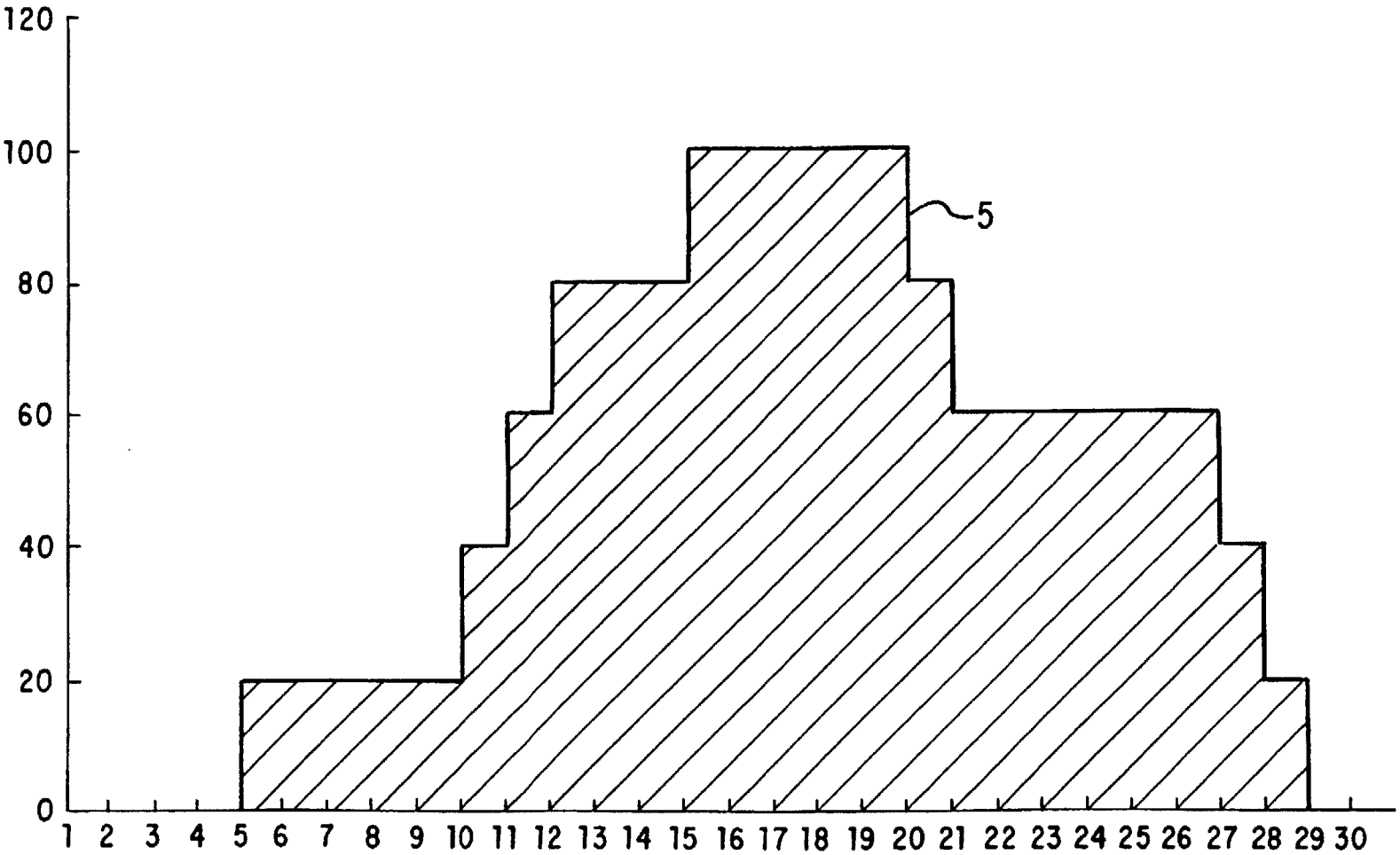

This difference is even more visible in FIGS. 2 and 3; given that the hatched regions, which represent the areas of the diagrams 4 and 5 (FIG. 1) are proportional to the volumes of air delivered (flow rates multiplied by times), it i noted that the mode of operation without lag (4) consumes less air than the mode with lag (5); however, the latter affords better comfort by removing the residual pollution for longer following occupation of the premises.

Figure 4:
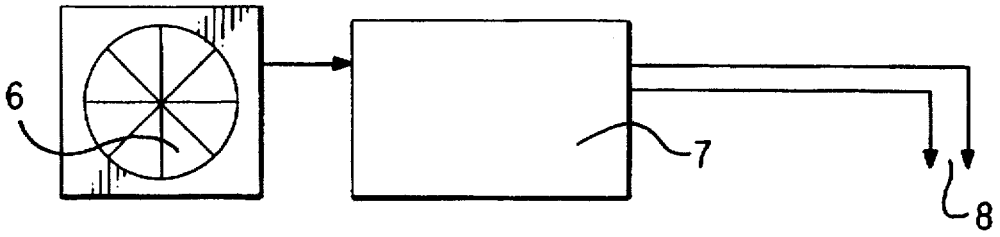
FIGS. 4 to 7 are schematic views of various embodiments of the device for adjusting ventilation.

Seen in FIG. 4 is the block layout for the operation of the device, which is the subject of the invention: a detection block 6 which detects the movements through a multiple lens for splitting the room to be ventilated into several zones, a processing block 7 which counts the number of detection per unit time and which computes the setpoint, in the form of an output signal 8.

Figure 5:
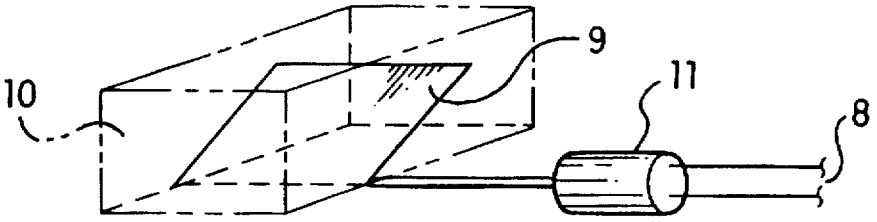

In FIG. 5 may be seen a flap 9 actuated within an air duct 10 by an electric motor 11 associated with a timer (open loop) which can operate in two ways: either the flap 5 is closed, and then a reverse voltage is applied to the motor 11 for a time which depends on the signal 8, and providing the requisite opening of the flap; or the previous position of the flap is known and the voltage is applied in the requisite direction for the time dependent on the signal 8, to obtain the new position of the flap.

Figure 6:
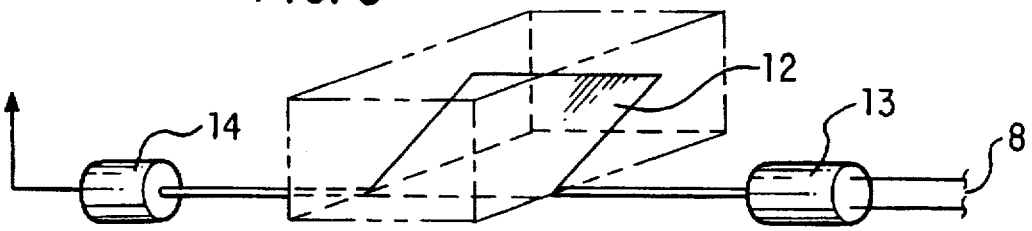

In FIG. 6 may be seen a flap 12 driven by an electric motor 13 associated with a device for copying the position of the flap, for example a potentiometer 14.

The voltage is applied in the requisite direction (according to the current position of the flap) to modify the position of the flap; it is the information feedback, connected to the processing card, which halts the motor when the envisaged position is reached.

Figure 7:
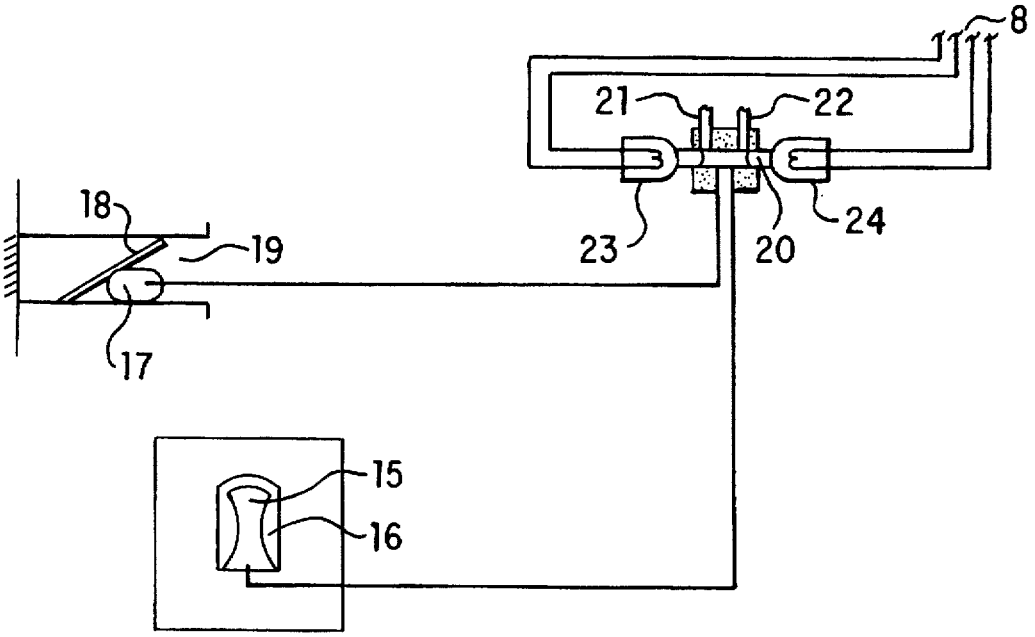

FIG. 7 represents two other variants of the device, which is the subject of the invention: here, a flexible pouch 15 with variable internal pressure, more or lens shuts off the air channel 16, or else a flexible pouch 17 with variable internal pressure drives a flap 18 mounted in the air channel 19 and thus adjusts the flow cross section and therefore the air flow rate.

The variable internal pressure in produced by the position of a piston 20 with respect to two pressure taps 21 and 22 (downstream of the vent and upstream of the vent); this position makes it possible to obtain a pressure intermediate between the two extreme pressures, which is then transmitted to the flexible pouch.

The position of the piston 20 is given by setpoints supplied to two capsules 23 and 24; these capsules are almost airtight volumes fitted with a thin deformable wall and incorporating an electrical heating element: by applying a voltage to this element, the air contained in the capsule heats up and expands, thereby deforming the thin wall, and driving the piston. Simultaneous application of voltages (or currents) to both heating elements makes it possible to position the piston very accurately and therefore to obtain the desired pressure.

In all cases, the invention makes it possible to ensure, within the network of conduits, a pressure which in substantially steady in the sense of ventilation, that is to say the overpressure remains within a ratio of 1 to 4, for example from 50 to 200 Pascals.

It is appreciated that the smoothing of the adjustment of the ventilation flow rate by restricting the rate of variation avoids spurts of flow rate variation.

Similarly, the smoothing of the adjustment by count averages is particularly beneficial if there is a risk of spurts occurring often without an appreciable change in the number of people (the example of a meeting room in which somebody gets up from time to time to go to the blackboard).

In an advantageous variant, a composite response is used: fast variation by flow rate increase so as to adapt rapidly to an increase in pollution; slower variation and with lag by flow rate reduction in order to remove the pollution remaining following occupation of the premises (the example of a restaurant in which the diners smoke at the end of the meal).

Finally, the node of operation with confirmation makes it possible to smooth out large spurts and to discard insignificant happenings (the example of the distributing of mail in offices).

Of course, it will still be advantageous to equip the device, which is the subject of the invention, with an override manual control.

I claim:

1. A method of adjusting ventilation of premises, comprising counting a number of movements of occupants of the premises for a given time, deducing from the number of movements a datum related to activity of the occupants and to a number of the occupants, and based upon the datum, directly varying an air flow cross section and consequently a flow rate of a ventilation device of the premises, in a same direction as the activity.

2. The method of adjusting ventilation of premises as claimed in claim 1, wherein the counting of the number of movements is carried out by a pyro-electric detector.

3. The method of adjusting ventilation of premises as claimed in claim 1, wherein the counting the number of movements occurs cyclically, for a period of less than thirty seconds, wherein the number of movements increment a counter.

4. The method of adjusting ventilation of premises as claimed in claim 3, further comprising reading the counter at regular intervals of less than thirty minutes, wherein a value read is compared with a prerecorded value dependent on occupancy of the premises, so as to yield an output signal, and wherein the counter is reset to zero after each reading.

5. The method of adjusting ventilation of premises as claimed in claim 4, wherein the output signal takes into account more than one reading of the counter based upon an average over a given number of readings, a discarding of unimportant readings, an introduction of a lag or a combination thereof.

6. The method of adjusting ventilation of premises as claimed in claim 4, further comprising processing the output signal as a function of a characteristic of the premises to be ventilated and of an associated adjusting hardware.

7. A device for adjusting ventilation of premises by the method as claimed in claim 1, comprising:

a device for counting the number of movements, and a processing block which counts the number of movements per unit time and which computes a setpoint in the form of an output signal which acts directly on a means of controlling a member for reducing the ventilation cross section, associated with a ventilator and a network of conduits enabling a pressure in the network to remain substantially steady.

8. The device for adjusting ventilation of premises as claimed in claim 7, wherein the member for reducing the ventilation cross section is located within the conduit or terminally and possesses a flap whose variable position is controlled by a motor.

9. The device for adjusting ventilation of premises as claimed in claim 7, wherein the member for reducing the ventilation cross section is located within the conduit or terminally and possesses a deformable pouch whose internal pressure is variable, associated or not with a flap.

10. The device for adjusting ventilation of premises as claimed in claim 7, wherein the member for reducing the ventilation cross section delivers a maximum flow rate of 100 to 500 $m^3/h$ in fixed increments of 15 to 50 $m^3/h$, respectively 10 to 20% of the maximum flow rate.

11. The method of adjusting ventilation of premises as claimed in claim 2, wherein the pyro-electric detector is a passive sensor of infrared radiation or a multiple lens for splitting the premises into zones.

12. A device for adjusting ventilation of premises as claimed in claim 7, wherein the pressure is kept within a ratio of 1 to 4.

13. A method of adjusting ventilation of premises comprising:

counting a number of movements of occupants of the premises for a given time cyclically, incrementing a counter using the number of movements, reading the counter at regular intervals and comparing a value from the counter with a prerecorded value, and resetting the counter to zero after each reading;

deducing a datum related to activity of the occupants and to a number of the occupants;

and based upon the datum, directly varying an air flow cross section and consequently a flow rate of a ventilation device of the premises, in a same direction as the activity.

* * * * *